US007594372B2

(12) United States Patent
Micnerski

(10) Patent No.: US 7,594,372 B2
(45) Date of Patent: Sep. 29, 2009

(54) FLEXIBLE CONTAINER FORMING APPARATUS HAVING INTEGRATED WEB SURFACE DEFORMATION

(75) Inventor: Kenneth Micnerski, Grayslake, IL (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 11/375,614

(22) Filed: Mar. 14, 2006

(65) Prior Publication Data

US 2007/0214749 A1 Sep. 20, 2007

(51) Int. Cl.
*B65B 47/02* (2006.01)

(52) U.S. Cl. ..... 53/453; 53/55; 53/558; 53/559; 53/563

(58) Field of Classification Search ..... 53/55, 53/478, 488, 558, 453, 559, 563
See application file for complete search history.

(56) References Cited

U.S. PATENT DOCUMENTS

| | | | | | |
|---|---|---|---|---|---|
| 2,776,607 | A | * | 1/1957 | Fischer et al. | 493/97 |
| 2,778,171 | A | * | 1/1957 | Taunton | 53/405 |
| 3,244,576 | A | * | 4/1966 | Swartz | 156/513 |
| 3,813,998 | A | * | 6/1974 | Lotto | 493/191 |
| 4,065,344 | A | * | 12/1977 | Weist | 156/250 |
| 4,166,412 | A | * | 9/1979 | Versteege | 493/193 |
| 4,566,250 | A | * | 1/1986 | Matsumura et al. | 53/500 |
| 4,656,813 | A | * | 4/1987 | Baldini et al. | 53/410 |
| 4,710,157 | A | * | 12/1987 | Posey | 493/213 |
| 4,718,215 | A | * | 1/1988 | Carveth et al. | 53/410 |
| 5,187,921 | A | * | 2/1993 | Wilson et al. | 53/453 |
| 5,647,511 | A | * | 7/1997 | Bond | 222/105 |
| 5,660,662 | A | * | 8/1997 | Testone | 156/145 |
| 5,788,620 | A | * | 8/1998 | Aeschbach | 493/212 |
| 5,868,658 | A | * | 2/1999 | Wild | 493/212 |
| 6,027,438 | A | * | 2/2000 | Frazier et al. | 493/196 |
| 6,045,006 | A | * | 4/2000 | Frazier et al. | 222/105 |
| 6,136,414 | A | * | 10/2000 | Aizawa et al. | 428/156 |
| 6,851,579 | B2 | * | 2/2005 | Savage et al. | 222/107 |
| 6,984,278 | B2 | * | 1/2006 | Anderson et al. | 156/209 |
| 7,022,058 | B2 | * | 4/2006 | Lee | 493/210 |

* cited by examiner

*Primary Examiner*—Rinaldi I. Rada
*Assistant Examiner*—Gloria R. Weeks
(74) *Attorney, Agent, or Firm*—Jovan N. Jovanovic; Vladan M. Vasiljevic; The Watson I.P. Group, PLC

(57) ABSTRACT

A flexible container forming apparatus which forms a flexible container from at least one film comprising a surface deformation assembly and a flexible container sealing assembly. The surface deformation assembly includes a subassembly which has a heating assembly and a surface deformation station. The heating assembly heats a portion of film, and the deformation station plastically deforms a portion of the film. The heating assembly includes a member for selectively introducing the film to the heated roller. The surface deformation station includes a member for directing the film in opposing directions. A slack accumulation assembly accumulates at least a portion of the film that has been deformed by the surface deformation station. The apparatus may include a filler device and a transfer assembly for transferring formed containers to a filler device.

11 Claims, 4 Drawing Sheets

FLEXIBLE CONTAINER FORMING APPARATUS HAVING INTEGRATED WEB SURFACE DEFORMATION

BACKGROUND OF THE INVENTION

1. Field of the Invention

The present invention relates to flexible container forming apparatuses and more particularly to a flexible container forming apparatus which can apply a surface deformation to a web of film during the flexible container formation process. For example, such surface deformations may comprise a texture or embossing which aids the evacuation of liquids, syrups and other flowable material from within the flexible container when in use. Additionally, the invention is directed to the coupling of such equipment to a filler device so as to provide a flexile container forming and filling apparatus having an integrated web surface deformation.

2. Background Art

The use of flexible containers is not new in the art. Typically, flexible containers have become increasingly popular for the storage, transport and dispensing of a number of different types of flowable materials. One drawback to the use of flexible containers has been the evacuation of same. Typically, when fluid is withdrawn from a flexible container, the walls of the flexible container collapse upon themselves so as to choke the evacuation and so as to preclude the full evacuation of a flexible container.

To facilitate improved evacuation, a number of different means have been developed. For example, one means by which to improve evacuation has been the addition of evacuation strips or other structures which preclude the collapse of the walls of the container against each other. Another means by which to improve evacuation comprises the deforming of the surface of the film so as to create passageways or channels within the film which assist the evacuation of liquids from the flexible containers. An example of such a flexible container is disclosed in U.S. Pat. No. 6,607,097 issued to Savage et al, entitled "Collapsible Bag for Dispensing Liquids and Method," and in U.S. Pat. No. 6,851,579 issued to Savage et al, entitled "Collapsible Bag for Dispensing Liquids and Method." The entire specification of each is incorporated by reference herein. Another such structure is disclosed in U.S. patent application Ser. No. 11/192,236 filed on Jul. 28, 2005 applied for by Micnerski et al, entitled "Collapsible Bag for Dispensing Liquids and Method." The entire specification of this application is incorporated by reference herein.

Typically, such containers are formed through a two step operation. The first step is to process a roll of film through a first piece of equipment which unrolls the film, applies the surface deformation thereto and returns the film to a roll. The re-rolled film is then positioned on a second piece of equipment which generally forms the flexible container from the already deformed film. One drawback with such a process is that the film must be processed through separate equipment and increased handling is required.

While such a procedure typically requires increased handling and processing, at the same time, there has been a concentration toward the minimization of handling required for the forming and filling of flexible containers. For example, certain equipment has been developed to form and seal flexible containers from one or more webs of material, and which then fill the formed and sealed flexible containers in an integrated filler devices. The increase in handling and processing which is required for containers having surface deformations is disadvantageous. It would be advantageous to combine surface deformation with the forming and sealing of flexible containers. It would be likewise advantageous to couple the surface deformation with forming, sealing and filling equipment.

Thus, it is an object of the invention to incorporate surface deformation of a film in association with the forming and sealing of a flexible container.

It is another object of the invention to incorporate surface deformation of a film in association with the forming, sealing and filling of a flexible container.

These and other objects of the invention will become apparent in light of the specification and claims appended hereto.

SUMMARY OF THE INVENTION

The invention is directed to flexible container forming and filling apparatuses. Specifically the flexible container forming and filling apparatus of the present invention comprises a flexible container forming assembly, a flexible container filling assembly and a transfer assembly. The forming assembly includes a flexible container sealing assembly and a surface deformation assembly which has at least one surface deformation subassembly. Each such subassembly includes a heating assembly, a surface deformation station and a slack accumulation assembly. The heating assembly includes means for selectively introducing the film to the heated roller. The surface deformation station includes means for directing the film in opposing directions therethrough. The slack accumulation assembly is configured for accumulating at least a portion of the film heated by the heating assembly and is positioned after the surface deformation station. The transfer assembly is positioned between the flexible container forming assembly and the flexible container filling assembly. The transfer assembly transfers formed flexible containers from the flexible container forming assembly to the flexible container filling assembly.

In a preferred embodiment, the heating assembly further comprises a heated roller. In one such embodiment, the selective introduction means further comprises a bracket having a first end pivotally coupled relative to the heated roller, a roller positioned at a second of the bracket, and means for pivoting the bracket about the first end so as to move the roller relative to the heated roller.

In another such preferred embodiment, the surface deformation subassembly comprises an embossing roller and a compression roller. The directing means comprises means for rotating the embossing roller in opposing directions.

In a preferred embodiment, the container is formed from two separate films. The surface deformation subassembly comprises at least one surface deformation subassembly for each web of film.

In another preferred embodiment, the transfer assembly and the filling assembly may be omitted, and the apparatus may comprise a flexible container forming apparatus.

In another aspect of the invention, the invention comprises a method of forming a container comprising the steps of (a) providing at least one film; (b) continuously deforming at least a portion of the surface of the at least one film; (c) accumulating film after the step of surface deforming; (d) indexing the film to a flexible container sealing assembly; and (e) sequentially activating the flexible container sealing assembly to form sequential containers.

In a preferred embodiment, the method further comprises the steps of separating sequentially formed containers from the film.

In another preferred embodiment, the method further comprises the steps of: heating at least a portion of the film against a heated roller; and forcing the film into contact with an embossing roller. In one such preferred embodiment, the method includes the steps of: lifting the film from the heated roller in the event that the method is stopped; reversing the film so that the portion of film just upstream of the portion that was against the embossing roller is positioned proximate the heated roller; and placing the film against the heated roller when the method is restarted.

BRIEF DESCRIPTION OF THE DRAWINGS

The invention will now be described with reference to the drawings wherein.

DETAILED DESCRIPTION OF THE INVENTION

Figure 1:
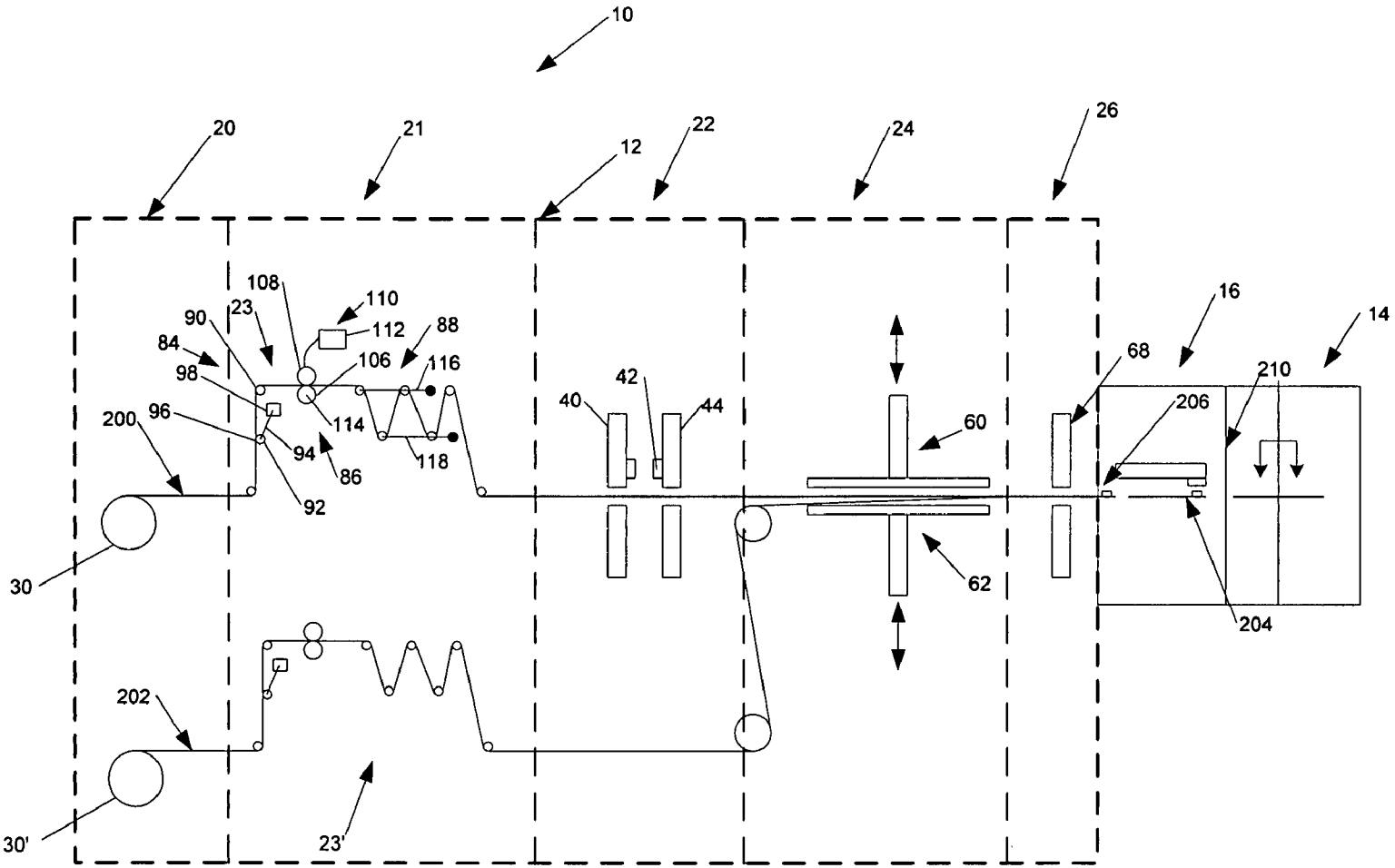
FIG. 1 of the drawings comprises a schematic side elevational view of the flexible container forming and filling apparatus of the present invention.
Figure 2B:
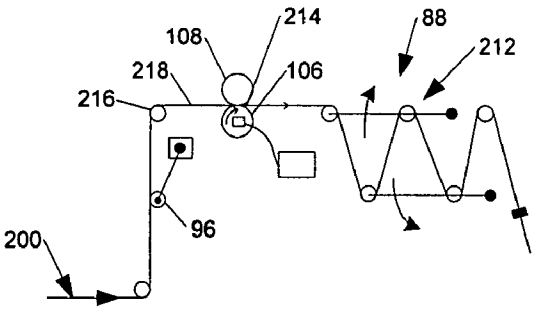
FIGS. 2(*a*) through 2(*f*) of the drawings comprise schematic side elevational views a surface deformation subassembly of the present invention each showing an operations phase thereof.
Figure 2D:
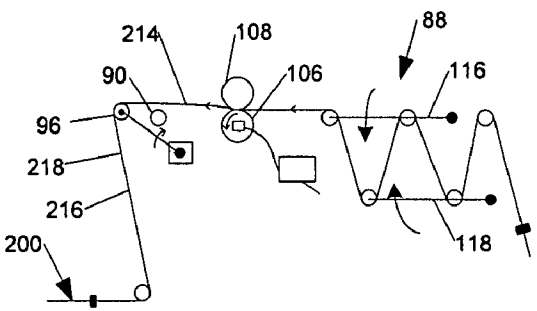
Figure 2A:
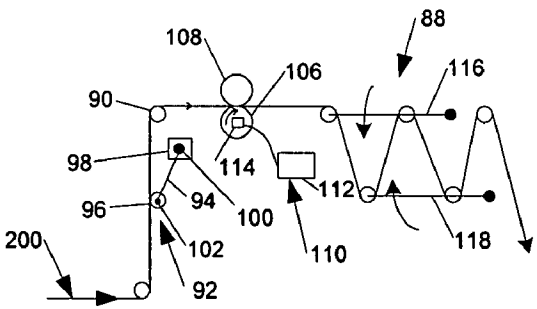
Figure 2C:
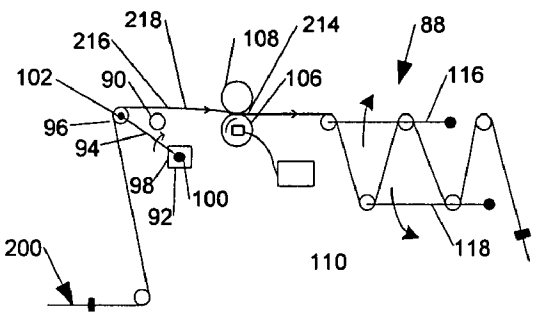
Figure 2F:
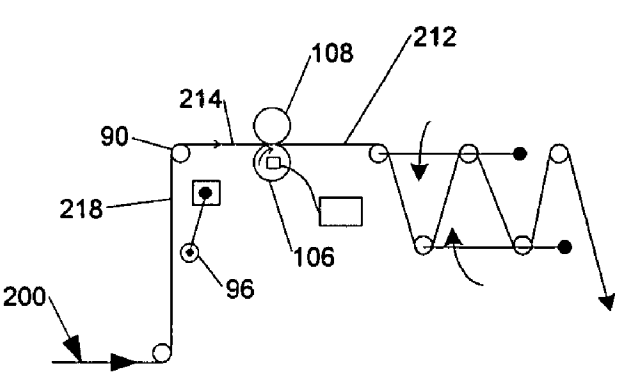
Figure 2E:
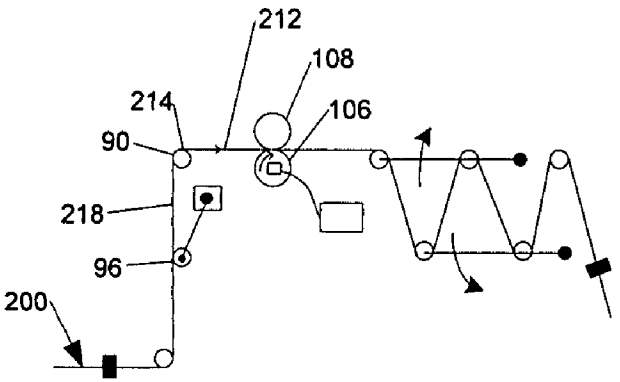

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the flexible container forming and filling apparatus is shown generally at 10 (the apparatus). Such an apparatus comprises a flexible container forming assembly 12, a flexible container filling assembly 14 and a flexible container transfer assembly 16. The particular equipment is positioned in-line such that the input into the equipment is a substantially planar web of film (such as webs/film 200, 202) and the output of the equipment is a filled flexible container (such as filled flexible container 204) which includes surface deformations. Such equipment is commonly referred to as form-seal-fill equipment, or FSF. In other embodiments, the flexible container forming assembly 12 can be positioned remotely from the flexible container filling apparatus. In such an embodiment, the flexible containers are formed then packaged into a larger container for shipment or transfer to a flexible container filling apparatus.

The apparatus is configured for formation and filling of a number of differently sized flexible containers having spouts thereon. For example, it is contemplated that the flexible containers may have a volume of between 1 and 10 liters. Indeed, the invention is not limited to any particular size or shape of flexible containers (i.e., less than 1 liter to containers larger than 1000 liters).

Furthermore, the filling assembly may transfer any number of different flowable materials into the formed flexible containers. Typically, the different flowable materials may comprise liquids, such as juices and industrial chemicals, as well as thicker fluids, such as syrups, oils and/or lotions. Of course, the invention is not limited to any particular type of flowable materials, and, it will be understood that the invention can be utilized with any material which can be handled properly by filling equipment.

Flexible forming assembly 12 comprises film supply subassembly 20, surface deformation assembly 21, spout attachment assembly 22, sealing assembly 24 and cutting assembly 26. The film supply subassembly 20 comprises rollers, such as roller 30 and roller 30'. In such an embodiment, one roller holds the first film web which forms the first wall of the pillow type container and the second roller holds the second film web which forms the second wall of the pillow type container. Of course, in other embodiments, multiple rollers may be utilized so as to form multi-ply flexible containers.

Roller 30 will be described with the understanding that roller 30' is substantially identical thereto. In one embodiment, roller 30 comprises a powered roller which is capable of rotating at a predetermined rate. The roller speed is controlled by, for example, a stepper motor or the like, such that the linear speed of the film as the film is unwound from the powered rollers is strictly controlled as the roll is depleted. The rollers include outwardly extendible clamps which apply a biasing means against the web roll, to, in turn, preclude relative movement of the web vis-à-vis the roller.

Surface deformation assembly 21 includes first film deformation subassembly 23 and second film deformation subassembly 23'. First film deformation subassembly 23 will be described with the understanding that the second film deformation subassembly 23' is substantially identical thereto. First film deformation subassembly 23 includes heating assembly 84, plastic deformation station 86, and slack accumulation assembly 88.

Heating assembly 84 is shown in FIG. 1 as comprising heated roller 90 and means 92 for selectively introducing the film to the heated roller. The heated roller 90 has an axis of rotation which is substantially parallel to the axis of rotation of roller 30, while not limited thereto. The heated roller may be heated to a desired range of temperatures, such, as for example 195° to 275° F., depending, in part, upon material and thickness, among other characteristics. In the embodiment shown, the film contacts the roller through about 90° of rotation. Of course, a greater film to roller contact or a lesser film to roller contact is likewise contemplated.

The selective introduction means 92 includes bracket 94, roller 96 and means 98 for pivoting the bracket. Bracket 94 is shown in greater detail in FIG. 2(*a*) as including a first end 100 and a second end 102. First end 100 is pivotably coupled to the heated roller or a frame thereof. Second end 102 extends therefrom. Roller 96 is rotatably coupled to second end 102. Bracket pivoting means 98 pivots the bracket from a first position wherein the roller 96 extends above heated roller 90 (FIG. 2(*c*)) to a second position wherein roller 96 pivots to a position below the heated roller (FIG. 1 and FIG. 2(*a*)). In one embodiment, the bracket pivoting means may comprise a stepper motor. In another embodiment, the bracket pivoting means may comprise an air cylinder or the like. Indeed, any number of different means for pivoting the bracket are contemplated.

Plastic deformation station 86 is shown in FIG. 1 as comprising embossing roller 106, compression roller 108 and means 110 for directing the embossing roller in opposing rotational directions. The surface deformation assembly is located downstream of the heated roller assembly. Embossing roller 106 essentially includes a plurality of valleys and hills which can impart a corresponding embossing onto the film from the web of film. Typically, the embossing roller comprises a hardened metal roller which can be utilized for an extended period of time without failure. In certain embodiments, the embossing roller may be chilled by a variety of cooling assemblies. For example, coolant may be directed into or through the embossing roller so as to reduce the temperature of the embossing roller.

The compression roller 108 is shown in FIG. 1 as comprising a roller which has an elastic and/or flexible outer surface. Such a roller can engage the surface features of the embossing roller. It will be understood that such a roller forces the film into close contact with the embossing roller so that the heated film plastically deforms to the surface configuration of the embossing roller. In the embodiment shown, the outer surface of the compression roller comprises a rubber material. In another embodiment, the roller may comprise a relatively hard material which has a complementary surface configuration to the embossing roller.

The roller directing means 110 includes a embossing roller controller 112 and a stepper motor 114. The stepper motor 114 is directed by controller 112 so as to rotate at a predetermined speed in a first direction. Additionally, and as will be explained, controller 112 facilitates the rotation of the stepper motor in a second opposite direction, when desired.

Slack accumulation assembly 88 is positioned downstream of surface deformation station and comprises opposing movable elements 116, 118 which selectively move away and toward each other. The opposing movable elements allow for the continuous operation of the rollers 30 and the surface deformation assembly 21 while permitting the indexed operations of the spout attachment and the sealing of the webs to form the container. As will be understood, as the web stops to undertake the spout attachment and sealing steps, the roller 30 continues to rotate and feed the web through the surface deformation assembly. Movable element 116 spreads away from element 118 so as to maintain the proper tension on the web moving through the surface deformation assembly regardless of the movement of the web through the remaining components and stations.

A number of different surface deformations and/or other textures are contemplated. For example, any one of the surface deformations disclosed in U.S. Pat. No. 6,607,097 issued to Savage et al, entitled "Collapsible Bag for Dispensing Liquids and Method," and in U.S. Pat. No. 6,851,579 issued to Savage et al, entitled "Collapsible Bag for Dispensing Liquids and Method" are contemplated for use. Additionally, the surface deformations disclosed in U.S. patent application Ser. No. 11/192,236 filed on Jul. 28, 2005 applied for by Micnerski et al, entitled "Collapsible Bag for Dispensing Liquids and Method" are likewise contemplated for use. Of course, other surface variations and deformations are likewise contemplated for use. The invention is not limited to any type of surface deformation, other than that the surface deformation is configured to assist with the evacuation of fluid from within the flexible container after formation and filling.

Figure 3:
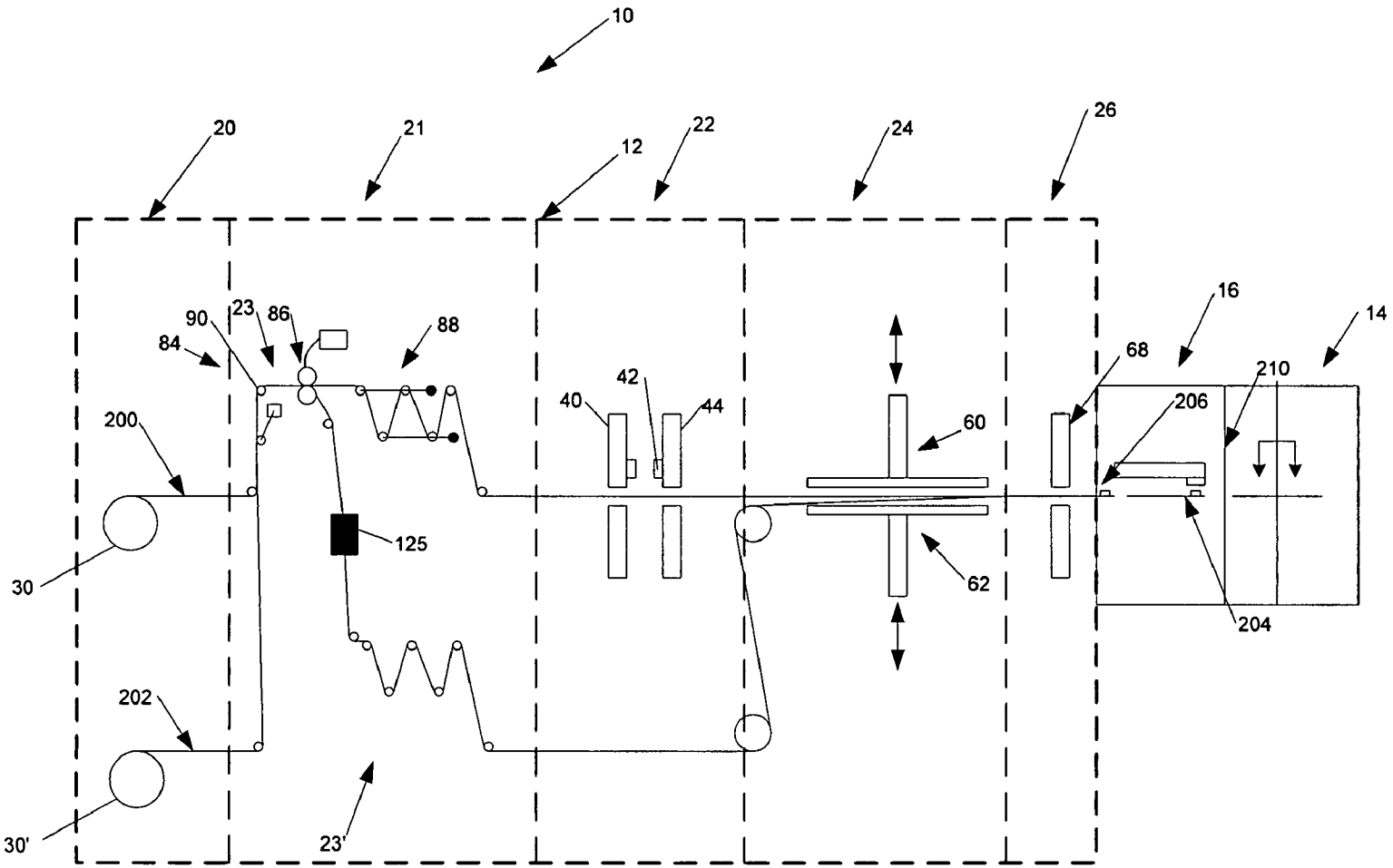
FIG. 3 of the drawings comprises a schematic side elevational view of an embodiment of the flexible container forming and filling apparatus of the present invention, showing, in particular, the surface deformation of multiple films simultaneously.

It is likewise contemplated that one or both of the films from web 30 and from web 30' may be directed through surface deformation assemblies. Indeed, as is shown in FIG. 1, both webs undergo a plastic surface deformation in separate surface deformation subassemblies. In other embodiments, only one of the surface deformation subassemblies may be employed, such that only one web includes plastic surface deformations. In yet another embodiment, as is shown in FIG. 3, both of the webs proceed through the same surface deformation assembly together and the surface deformation assembly applies a surface deformation to each of the two webs simultaneously. In such an embodiment, one of the two films is rotated in rotation station 125 before container formation so that the appropriate sides of the respective webs form the inside surfaces of the flexible container.

Spout attachment assembly 22 is shown in FIG. 1 as comprising film spout opening cutting assembly 40, spout handling and positioning assembly 42 and spout sealing assembly 44. It will be understood that the spout attachment assembly is configured to form the film spout opening, position the spout and attach the spout to the outside of the flexible container. In the embodiment shown, the spout attachment assembly 22 attaches a spout to the film proximate the opening.

Film spout opening cutting assembly 40 comprises cutting head which forms an opening in the film at a predetermined position. Spout handling and positioning assembly 42 include grasping components (not shown) which are configured to grasp, retain and release the bag, the spout and/or the fitment as desired, as well as means for moving the components into a desired orientation for attachment.

Spout sealing assembly 44 comprises a heating element which is configured to seal the spout to the film. Of course, a number of different spout sealing assemblies are contemplated. In certain configurations, the spout may be sealed through RF sealing. The invention is not limited to any particular sealing method or sealing structure.

Flexible container sealing assembly 24 is shown in FIG. 1 as comprising upper plate 60, lower plate 62. At least one of upper plate 60 and lower plate 62 includes a sealing pattern. It will be understood that as the upper and lower plates are pressed together, the sealing pattern melts the separate layers of film so as to join the film and so as to define the cavity of each flexible containers.

Cutting assembly 26 is shown in FIG. 1 as comprising transverse cutter 68. Transverse cutter 68 separates sequential flexible containers formed from the webs. The finished flexible containers exit the flexible container forming assembly at output 206. In certain embodiments, wherein the containers are not immediately filled, the cutting assembly may be omitted and the formed web of containers may be collected in a separate container for shipment.

The other end of the system comprises flexible container filling assembly 14. The flexible container filling assembly comprises a rotary filler. One such rotary filler configured for use with the present invention is shown and described in U.S. Pat. No. 6,786,252 issued to Erb et al, entitled "Machine for Filling Bags or the Like Comprising a Control Device with Cams," the entire specification of which is incorporated by reference. Of course, the present invention is not limited to such a rotary filler, and, other rotary fillers are contemplated for use, including, but not limited to, U.S. Pat. No. 6,655,109 issued to Resterhouse et al, entitled "Filler Device Sub-Assembly and Associated Method," the entire specification of which is incorporated by reference. Such rotary fillers, as well as other rotary fillers, include a plurality of stations which rotate about a central axis. Generally, such rotary fillers receive a flexible container at each station sequentially at a common input region. As the rotary filler rotates, the flexible container is uncapped, filled and recapped. Finally, it is released from the rotary filler and positioned into another container or onto a conveyor for further processing.

As set forth in the foregoing incorporated disclosures, the filling stations of any such rotary filler are configured to receive a flexible container at a particular input region in the rotation process, fill the flexible container, and release the flexible container at another predetermined region. Such a cycle continues as the filling stations rotate about the central axis.

In the present apparatus, a transfer assembly 16 couples flexible container forming assembly 12 with flexible container filling assembly 14, so as to transfer any flexible containers formed in the flexible container forming assembly to the flexible container filling assembly. As will be explained below, the flexible containers 204*a* are sequentially introduced into the flexible container filling assembly and captured by the flexible container filling assembly at generally the same receiving region, namely receiving region 210. Generally, the receiving region 210 is defined by a relatively small region in which sequential filler heads and filler stations are capable of receiving and retaining a flexible container. Of course, the invention is not limited to any particular manner or means by which to transfer the flexible container to the filler device.

In operation, the film proceeds from the respective roll to the respective surface deformation assembly. The surface deformation assembly will be described with respect to one of the films with the understanding that the operation of the other surface deformation assembly is substantially identical. Specifically, and with reference to FIG. 2(*a*) the film first presses against and along the heated roller 90 and is heated to a desired temperature. For the film to pass against the heated roller, the roller 96 of the selective introduction means must be positioned in a second position.

Once heated, the film is pressed by the compression roller 108 into abutting contact with embossing roller 106. Inasmuch as the film has been heated by the heated roller to a predetermined temperature, the pressing between the compression roller and the embossing roller causes plastic deformation of the film into a configuration substantially matching that of the embossing roller. In certain embodiments, the embossing roller may be chilled so as to cool the film during the surface deformation. In other embodiments, a chilled roller may be positioned downstream of the embossing roller.

With reference to FIG. 1, once the surface has been plastically deformed as desired, the film proceed to through the slack accumulation assembly wherein the adjustments to the speed of the film can be made. As will be understood, the steps after the embossing are indexed steps, wherein the film generally stops for a period of time at each station prior to proceeding.

The film is indexed through the forming equipment incrementally, stopping at each one of a number of stations. Specifically, film spout opening cutting assembly 40 cuts an opening for attachment of the spout. Next, the spout handling and positioning assembly 42 positions the spout relative to the opening in preparation of attachment thereto. Next, the spout is sealed to the film by spout sealing assembly 44. In certain embodiments, the film spout opening cutting assembly can be removed wherein the spout is attached to the film without first forming the opening. In the present embodiment, the spout opening cutting assembly 40 cuts a hole in the film and the spout sealing assembly seals, sequentially, the spouts which are positioned by the spout handling and positioning assembly.

Once the spouts have been properly attached, the webs are joined together in the flexible container sealing assembly. In particular, the upper and lower plates 60, 62 of the flexible container sealing assembly form heat seals so as to define two separate flexible containers, each having a cavity which is accessible by way of the spout.

As each flexible container is completed, it is separated from the web by the cutting assembly 68. The separated and completed flexible container 204 is then grasped by the transfer assembly 16 and transferred to the flexible container filling assembly at a receiving region 210.

From time to time, it may be necessary to stop the apparatus. In certain instances the apparatus can be stopped at predetermined stages, such as upon completion of a cycle at the indexing stations. In other instances, the equipment is stopped without regard to the cycle completion. It is not uncommon to stop a system multiple times each shift of operation for a variety of different reasons.

As is shown in FIG. 2(*b*), when stopped, a first region of film 212 having a plastic deformation is positioned within the slack accumulation assembly, a second region of film 214 remains in contact with the embossing rollers, and a third region of film 216 remains in contact with the heated rollers. As the heated roller remains in contact with the third region of film, continued exposure of the film to heat will damage this region of the film. As such, to preclude damage to the third region of the film, as is shown in FIG. 2(*c*), the selective introduction means is employed to lift the film from the heated roller. Specifically, roller 96 is rotated by the bracket about axis 100 from a second position to a first position. In the first position, the film is lifted from the heated roller.

A fourth region of film 218 between the heated roller and the embossing roller cools once the equipment stops. The fourth region of film was heated by the heated roller, but was not plastically deformed prior to the stopping of the apparatus. Naturally, this fourth region of film cools as the equipment is stopped. Once the apparatus has been stopped for even a short period of time, if this portion of film is transmitted through the embossing roller without reheating, fourth region of film 218 will not be of sufficient temperature to be plastically deformed by the embossing roller.

As such, and with reference to FIG. 2(*d*), once the system has been stopped, the embossing roller 106 rotates in a reverse direction to direct second region of film 214 out of the embossing roller until the second region of material 214 is proximate the heated roller. The system is maintained in such a position until restarted. Another slack accumulation assembly (not shown) may be positioned between the roller and the embossing roller so as to take up any slack when the embossing roller in rotated in a reverse direction. It is likewise contemplated that the selective introduction means 92 may take up any slack that exists between these elements.

Once restarted, and with reference to FIG. 2(*e*), the selective introduction means is again activated. Specifically, roller 96 is again directed to a second position and the film is returned to contact with the heated roller. As the film has been reversed from the embossing roller to the heated roller, the heated roller contacts the film beginning with the second region of film. As such, the embossing rollers will not attempt to plastically deform a portion of the film prior to heating thereof, and, the plastic deformation of the film will remain continuous despite the stopping and the restarting of the system (i.e., there are not gaps in the surface deformation caused by the stopping and starting of the equipment). Such a configuration is minimizes the number of containers that would be deemed defective as having a portion of film that lacks the necessary surface deformations.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A method of forming a container comprising the steps of:

providing at least one film;

heating at least a portion of the film against a heated roller;

forcing the film into contact with an embossing roller, to in turn, continuously deform-at least a portion of the surface of the at least one film into a plurality of peaks and valleys;

accumulating film after the step of surface deforming;

indexing the film to a flexible container sealing assembly;

sequentially activating the flexible container sealing assembly to form sequential containers;

separating the film from the heated roller in the event that the step of providing the at least one film is stopped;

reversing the film so that the portion of film that was against the embossing roller is directed backwards so as to be positioned at the heated roller to, in turn, facilitate the reheating of film which had been heated prior to the step of separating but which had not undergone the step of forcing, to in turn, maintain a substantially continuous embossing of peaks and valleys; and engaging the film with the heated roller when the method is restarted, at the location where the embossing ceased on the film, to reheat the location, to in turn, render a substantially continuous embossing of peaks and valleys.

2. The method of claim 1 further comprising the step of separating sequentially formed containers from the film.

3. A method of forming a film for a container comprising the steps of:

providing at least one film;

heating at least a portion of the film against a heated roller;

forcing the film into contact with an embossing roller, to in turn, continuously deform at least a portion of the surface of the at least one film into a plurality of peaks and valleys;

accumulating film after the step of surface deforming;

separating the film from the heated roller in the event that the step of providing the at least one film is stopped;

reversing the film so that the portion of film that was against the embossing roller is directed backwards so as to be positioned at the heated roller to, in turn, facilitate the reheating of film which had been heated prior to the step of separating but which had not undergone the step of forcing, to in turn, maintain a substantially continuous embossing of peaks and valleys; and engaging the film with the heated roller when the method is restarted at the location where the embossing ceased on the film, to reheat the location, to in turn, render a substantially continuous embossing of peaks and valleys.

4. A flexible container forming and filling apparatus which forms a flexible container from at least one film and fills the formed container, the apparatus comprising:

a flexible container forming assembly including:

a surface deformation assembly comprising at least one surface deformation subassembly having a heating assembly including a heated roller for heating a portion of a film, the heating assembly including means for selectively introducing the film to the heated roller;

a surface deformation station following the heating assembly configured for plastically deforming at least a portion of the film heated by the heating assembly to form a plurality of valleys and hills on the film, the surface deformation station including means for directing the film in opposing directions therethrough, such that after the operation of the surface deformation assembly is stopped, and prior to restarting thereof, the film heated by the heating assembly but not deformed by the surface deformation station can be rewound to a position at the heating assembly, such that the film is reheated when the surface deformation assembly is restarted, beginning with the region of the film which was previously heated but not deformed by the deformation station prior to stopping;

a slack accumulation assembly configured for accumulating at least a portion of the film, positioned after the surface deformation station; and a flexible container sealing assembly;

a flexible container filling assembly; and a transfer assembly positioned between the flexible container forming assembly and the flexible container filling assembly, the transfer assembly transferring formed flexible containers from the flexible container forming assembly to the flexible container filling assembly.

5. The apparatus of claim 4 wherein the means for selectively introducing the film further comprises:

a bracket having a first end pivotally coupled relative to the heated roller;

a roller positioned at a second end of the bracket; and means for pivoting the bracket about the first end so as to move the roller relative to the heated roller.

6. The apparatus of claim 4 wherein the surface deformation subassembly comprises an embossing roller and a compression roller, the means for directing comprises means for rotating the embossing roller in a clockwise and a counterclockwise direction.

7. The apparatus of claim 4 wherein the container is formed from two separate films, the surface deformation subassembly comprises at least one surface deformation subassembly for each web of film.

8. A flexible container film forming apparatus which forms film for a flexible container, the apparatus comprising:

a surface deformation assembly comprising at least one surface deformation subassembly having a heating assembly including a heated roller for heating a portion of a film, the heating assembly including means for selectively introducing the film to the heated roller;

a surface deformation station following the heating assembly configured for plastically deforming at least a portion of the film heated by the heating assembly to form a plurality of valleys and hills on the film, the surface deformation station including means for directing the film in opposing directions therethrough, such that after the operation of the surface deformation assembly is stopped, and prior to restarting thereof, the film heated by the heating assembly but not deformed by the surface deformation station can be rewound to a position at the heating assembly, such that the film is reheated when the surface deformation assembly is restarted, beginning with the region of the film which was previously heated but not deformed by the deformation station prior to stopping;

a slack accumulation assembly configured for accumulating at least a portion of the film, positioned after the surface deformation station.

9. The apparatus of claim 8 wherein the selective introduction means further comprises:

a bracket having a first end pivotally coupled relative to the heated roller;

a roller positioned at a second end of the bracket; and means for pivoting the bracket about the first end so as to move the roller relative to the heated roller.

10. The apparatus of claim 8 wherein the surface deformation subassembly comprises an embossing roller and a compression roller, the directing means comprises means for rotating the embossing roller in a clockwise and a counterclockwise direction.

11. The apparatus of claim 8 wherein the container is formed from two separate films, the surface deformation subassembly comprises at least one surface deformation subassembly for each web of film.

* * * * *